US008746358B2

(12) United States Patent
Alchalel et al.

(10) Patent No.: US 8,746,358 B2
(45) Date of Patent: Jun. 10, 2014

(54) DEVICE, SYSTEM AND METHOD OF OPERATING FIRE EXTINGUISHING UNITS

(75) Inventors: Elan Alchalel, Kibbutz Lehavot HaBashan (IL); Israel Skitnevsky, Kibbutz Lehavot HaBashan (IL); Carlos A. Feller, Kibbutz Lehavot HaBashan (IL)

(73) Assignee: Lehavot Fire Protection Ltd., Kibbutz Lehavot HaBashan (IL)

( * ) Notice: Subject to any disclaimer, the term of this patent is extended or adjusted under 35 U.S.C. 154(b) by 982 days.

(21) Appl. No.: 12/716,296

(22) Filed: Mar. 3, 2010

(65) Prior Publication Data

US 2011/0214888 A1 Sep. 8, 2011

(51) Int. Cl.
*A62C 2/00* (2006.01)

(52) U.S. Cl.
USPC ..... 169/46; 169/54

(58) Field of Classification Search
CPC ..... A62C 35/68
USPC ..... 169/54, 60, 68, 16, 17, 19, 5
See application file for complete search history.

(56) References Cited

U.S. PATENT DOCUMENTS 3,703,930 A * 11/1972 Lofstrand et al. ..... 169/60
3,713,491 A 1/1973 Grabowski et al.
3,952,809 A 4/1976 Osborne
3,990,518 A * 11/1976 Hemme ..... 169/60
4,351,394 A * 9/1982 Enk ..... 169/61
6,685,104 B1 * 2/2004 Float et al. ..... 239/63
2009/0321093 A1 12/2009 Lalouz
2010/0065287 A1 * 3/2010 Burkhart et al. ..... 169/17

FOREIGN PATENT DOCUMENTS

DE 20209353 11/2002
JP 10-216257 8/1998

OTHER PUBLICATIONS

International Search Report and the Written Opinion Dated Jul. 1, 2011 From the International Searching Authority Re. Application No. PCT/IL2011/000204.

International Preliminary Report on Patentability Dated Sep. 13, 2012 From the International Bureau of WIPO Re. Application No. PCT/IL2011/000204.

* cited by examiner

*Primary Examiner* — Davis Hwu

(57) ABSTRACT

A system of operating a plurality of fire extinguishing units. The system comprises a plurality of valve control units each set to activate one of the plurality of fire extinguishing units when triggered and to trigger the activation of another of the plurality of fire extinguishing units by another of the plurality of valve control units substantially simultaneously and an actuating element which triggers one of the plurality of valve control units.

18 Claims, 10 Drawing Sheets

DEVICE, SYSTEM AND METHOD OF OPERATING FIRE EXTINGUISHING UNITS

FIELD AND BACKGROUND OF THE INVENTION

The present invention, in some embodiments thereof, relates to fire extinguishing and, more particularly, but not exclusively, to device, system and method of operating a number of fire extinguishing units.

Fires in establishments, such as commercial cooking establishments, workshops and factories, are a serious concern. For example, fires in commercial cooking equipment, such as fires in cooking equipment in U.S. homes, have a relatively high frequency but a relatively low average severity. These fires typically occur while an awake, unimpaired adult is nearby. The most frequent causes these fires include the abundant fuel load and ignition sources which are available in the cooking and/or heating process, for example grease and cooking residue, and the ventilation and/or airing of the establishment. Fire hazards are also found in frying appliances as they heat oils and fats nearly to their flashpoints It should be noted that exhaust systems for restaurant, cooking and/or heating equipments require careful design, because grease may condense in the interior of the ducts. Grease accumulations may be ignited by sparks from the cooking appliance and/or a fire caused by overheated cooking oil or fat in a cooking appliance, such as deep-fat fryer and a grill. For example, fats and oils may reach their self-ignition temperatures when inadvertently overheated or ignited when being in contact with a cooking appliance.

Usually, fixed fire suppression systems are used as a fire control solution, with portable fire extinguishers being secondary. Such systems are set to comply with the requirements of UL 300, Standard for Safety Fire Testing of Fire Extinguishing Systems for Protection of Restaurant Areas, which is incorporated herein by reference. Fire detectors are used to activate the suppression systems. Whether they are of the mechanical link or electronic sensor type, they are applied at a rating and location that permit them to respond promptly to any abnormal temperatures.

During the last years, a number of systems have been developed to automate hand held fire extinguishers and/or to provide automatic fire extinguishing solutions. For example, U.S. Patent Application Publication No. 2009/10321093, filed on Jun. 29, 2008 describes an automatic fire-suppression system that upon a predetermined fire condition is capable of detecting said fire condition and automatically dispensing and dispersing fire suppressant material over the abnormal fire. The system is independent of the appliance and does not require any external energy to operate. Furthermore the fire suppression system is capable of disconnecting an external gas or electricity supply line upon a fire condition.

SUMMARY OF THE INVENTION

According to some embodiments of the present invention there is provided a system of operating a plurality of fire extinguishing units. The system comprises a plurality of valve control units each set to activate one of the plurality of fire extinguishing units when triggered and to trigger the activation of another of the plurality of fire extinguishing units by another of the plurality of valve control units substantially simultaneously and an actuating element which triggers one of the plurality of valve control units.

Optionally, the actuating element triggers the activation of all the plurality of fire extinguishing units by triggering the one of the plurality of valve control units.

Optionally, plurality of valve control units are set to be connected in a chain by a plurality of mechanical linkages.

More optionally, the activation of all the plurality of fire extinguishing units is performed by a mechanical chain reaction.

Optionally, the system further comprises at least one mechanical linkage each connecting between two of the plurality of valve control units, each the valve control unit triggering the another valve control unit by driving one of the at least one mechanical linkage.

Optionally, each the valve control unit is set to activate one of the fire extinguishing units by manipulating a discharge valve thereof.

Optionally, each the valve control unit mechanically activates one of the plurality of fire extinguishing units.

Optionally, each the fire extinguishing unit is detachably connected to a respective the valve control unit so as to allow detaching any of the plurality of fire extinguishing units without triggering any other of the plurality of fire extinguishing units.

Optionally, each the valve control unit mechanically triggers another valve control unit.

More optionally, the system further comprises a fire detection unit for activating the actuating element in response to the detection of a fire indication.

More optionally, the fire detection unit comprises a mechanical heat activation device.

Optionally, each the fire extinguishing unit is detachably connected to a respective the valve control unit so as to allow the detaching thereof without disassembling the valve control unit.

According to some embodiments of the present invention there is provided a system of operating a plurality of fire extinguishing units. The system comprises a plurality of valve control units each performs an activation of one of the plurality of fire extinguishing units when being triggered and at least one mechanical linkage each connecting between two of the plurality of valve control units. Each member of a group of the plurality of valve control units is set to trigger another of the plurality of valve control units by driving one of the at least one mechanical linkage simultaneously with the activation.

Optionally, the at least one mechanical linkage is a flexible cable.

Optionally, the system further comprises a single detection unit which detects at least one fire indication and triggers one of the plurality of valve control units in response to the at least one fire indication.

According to some embodiments of the present invention there is provided a valve control unit of controlling a fire extinguishing unit. The valve control unit comprises a mechanical linkage which is set to trigger an activation of a first fire extinguishing unit by another valve control unit when being driven and a mechanical lever having first and second positions, when the mechanical lever being in the second position it is set to activate a second fire extinguishing unit and to drive the mechanical linkage simultaneously.

Optionally, the mechanical lever switches from the first position and to the second position by another mechanical linkage connected thereto.

Optionally, the valve control unit further comprises a fire detector and an actuating element which switches between the first and second positions in response to an output of the fire detector.

According to some embodiments of the present invention there is provided a method of operating a plurality of fire extinguishing units. The method comprises activating a first of the plurality of fire extinguishing units using a mechanical lever and driving a mechanical linkage connected to a valve control unit to activate a second of the plurality of fire extinguishing units. The activating and driving are performed simultaneously by maneuvering the mechanical lever.

Optionally, the driving comprises pulling the mechanical linkage.

Optionally, the driving triggers a maneuvering of an additional mechanical lever set to activate the second fire extinguishing and to drive an additional mechanical linkage connected to an additional valve control unit to activate a third of the plurality of fire extinguishing units.

According to some embodiments of the present invention there is provided a method of setting a fire suppression system having a plurality of fire extinguishing units. The method comprises mounting a plurality of valve control units in a plurality of surfaces in a space, setting each the valve control to activate one of the plurality of fire extinguishing units in response to the triggering thereof, establishing a mechanical linkage between each two of the valve control units, and connecting a first of the valve control units to an actuating element set to trigger one of the valve control unit. A triggering of the first valve control unit activates one of the plurality of fire extinguishing units and drives mechanical linkage to trigger all other of the valve control units.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF EMBODIMENTS OF THE INVENTION

Figure 1:
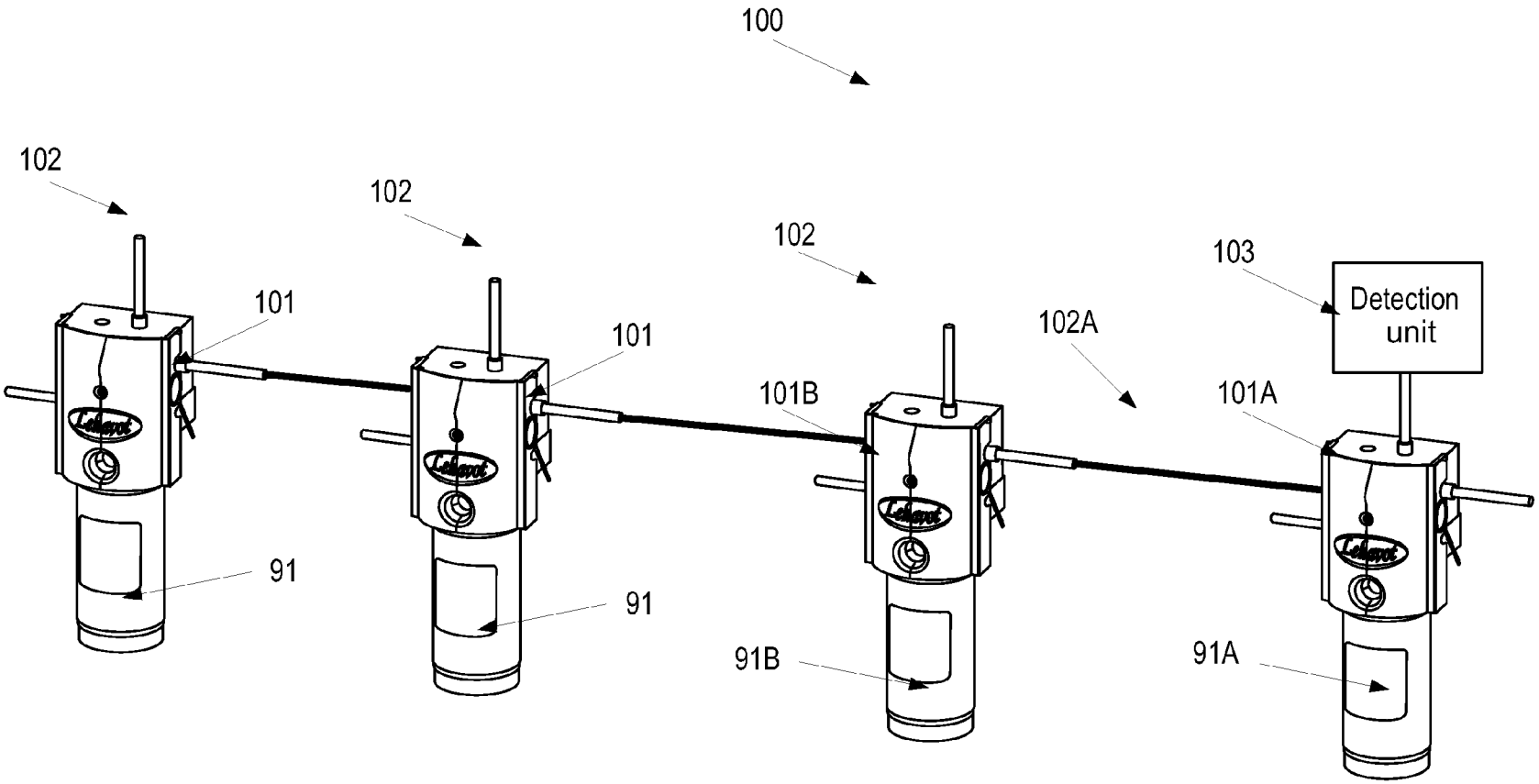
FIG. 1 is a system of operating a plurality of fire extinguishing units to suppress fire from a number sources spread in a space, according to some embodiments of the present invention.

The present invention, in some embodiments thereof, relates to fire extinguishing units and, more particularly, but not exclusively, to device, system and method of operating fire extinguishing units.

According to some embodiments of the present invention there is provided a method and system of operating a plurality of fire extinguishing units in a mechanical chain reaction to suppress fire from a number of sources spread in a space. The system comprises a plurality of valve control units. Each two of the plurality of valve control units are connected by a mechanical linkage, such as a cable. Each valve control unit is set to activate a fire extinguishing unit, such as common fire extinguisher, when triggered and to trigger another valve control unit. The triggering is optionally performed by pulling, rotating, pushing or otherwise driving the mechanical linkage that connects between the valve control unit and the other valve control unit. In such a system, the plurality of valve control units may be mechanically triggered substantially simultaneously. Optionally, the first of the valve control units is connected to an actuating element which is controlled either manually or automatically. Optionally, the actuating element is operated according to the outputs of one or more fire detectors. For example, when one of the fire detectors detects a fire indication, the actuating element triggers one of the valve control units, setting off a mechanical chain reaction wherein all the other valve control unit activate a plurality of fire extinguishing unit substantially simultaneously. As the system allows activating, substantially simultaneously, a plurality of fire extinguishing units by mechanical triggers, no electricity infrastructure or battery is needed for facilitating the mechanical chain reaction.

According to some embodiments of the present invention there is provided a control valve unit of controlling a fire extinguishing unit. The control valve unit includes a mechanical linkage which is set to trigger an activation of a fire extinguishing unit by another valve control unit when it is pulled. The control valve unit further includes a mechanical lever having first and second positions where when it is in the second position it is set to activate another fire extinguishing unit and to drive the mechanical linkage simultaneously.

Optionally, the mechanical lever switches from the first position and to the second position by another mechanical linkage which is connected thereto.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Reference is now made to FIG. 1 which is a system 100 of operating a plurality of fire extinguishing units 91, such as detachable extinguishing canisters, to suppress fire from a number sources spread in a space, according to some embodiments of the present invention. The fire extinguishing unit 91 includes a discharging valve supported on a pressure vessel, optionally cylindrical. The pressure vessel may be provided in various sizes, for example 6 liter capacity, 9 liter capacity, 16 liter capacity, and 26 liter capacity. The pressure vessel contains an agent which can be discharged to extinguish a fire, for example a gaseous agent that inhibits the chemical reaction of the fire, such as halocarbon agents. The agent may include wet chemicals, such as potassium acetate, carbonate, and/or citrate and dry chemicals, such as Ammonium phosphate, Sodium bicarbonate, Potassium bicarbonate, potassium bicarbonate and urea complex, potassium chloride, foam-compatible, and MET-L-KYL, foams such as aqueous film forming foam (AFFF), Alcohol-resistant aqueous film forming foams (AR-AFFF), film forming fluoroprotein (FFFP) and/or compressed air foam.

The system 100 may be used in various spaces, for example commercial kitchens, workshops, factories, production lines, and/or any other room or area in which food or products are prepared, for example cooked and/or heated. For brevity, numerals in these figures are referred to with the marked letters when the reference is made to a single exemplary unit and without in any other reference.

The system 100 includes a plurality of valve units 101 which are optionally connected to one another by mechanical linkages 102, such as a flexible rod, a steel rod, a control cable, such as a Bowden type control cable, a hydraulic set up and the like. Optionally, a different mechanical linkage connects between each two of the plurality of valve units 101. The mechanical linkages 102 are optionally placed in tubes. In such a manner, the mechanical linkages are protected from sharp objects and/or heat and/or fire damages.

Each valve control unit, for example 101A, is set to activate of the fire extinguishing unit, for example fire extinguishing unit 91A, when triggered, and to trigger one or more other valve control units 101, for example 101B, so as to activate one or more other fire extinguishing unit 91, for example 91B by pulling, rotating, pushing or otherwise driving one or more mechanical linkages which are connected to one or more other valve control units 101 to activate of other fire extinguishing units 91, for example pulling mechanical linkage 102A that is connecting between valve control units 101A and 101B. Each valve control unit 101 is set to perform the activation of the respective fire extinguishing unit 91 and the pulling of the respective mechanical linkage 102 substantially simultaneously, for example in less than 1 second.

As the triggering of one of the valve control units 101 triggers a series of activations of different fire extinguishing units by one or more other valves which are connected thereto. As further described below, the triggering of one of the valve control units 101 immediately triggers the activation of another valve control unit 101. Such a chain reaction allows activating the fire extinguishing units 91 substantially simultaneously.

The system 100 includes one or more actuating elements for triggering one of the valve control units 101. The fire extinguishing unit 101A is connected to an actuating element (not shown) which is connected to a detection unit 103 having one or more fire detectors, for example a mechanical heat activation device, such as fusible link fire detector of Globe Technologies Corporations™, for example model M or model K and/or rise of rate (RoR) detector, and optionally operated according to the detection unit 103 outputs, which are optionally mechanical outputs, for example the melting of a fusible link. In such a manner, when fire detector 103 reacts to a fire heat in a manner that causes the actuating element to trigger valve control unit 101A. Other detectors such as an irregular temperature sensor, a smoke sensor, an IR radiation sensor and the like may also be used if adjusted to cause the actuating element to trigger valve control unit 101A. This trigger causes to a chain reaction, for example as described above, which activates all the fire extinguishing units 91 substantially simultaneously. Optionally, the actuating element is operated by a number of fire detectors. Additionally or alternately, the actuating element is connected to a manual control, for example a pullable string, ratable string, and/or a ring. This manual control allows a user to manually activate the fire extinguishing units 91, optionally substantially simultaneously, for example as described below.

Figure 2:
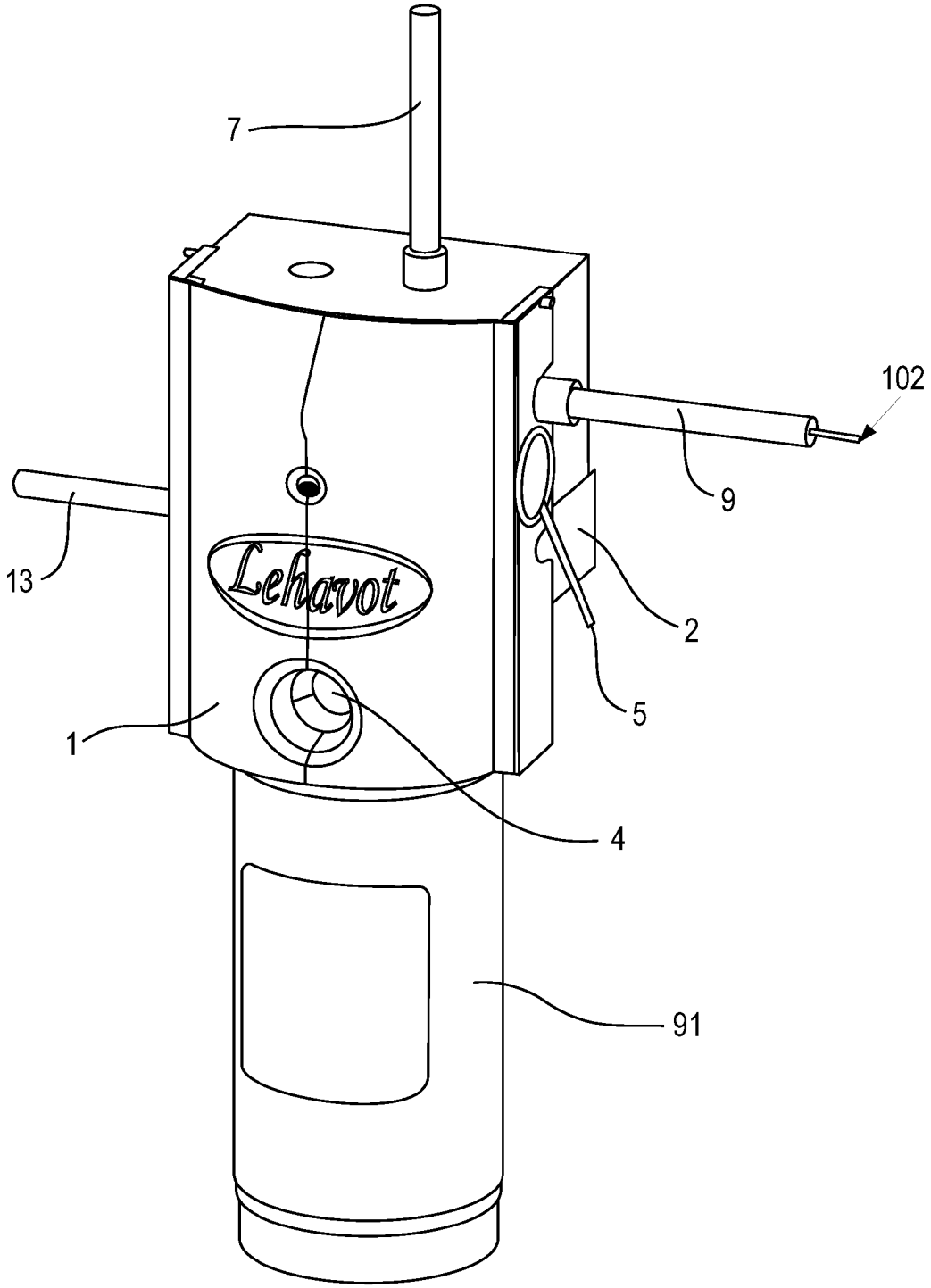
FIG. 2 is a schematic illustration of an exemplary valve control unit connected to an exemplary fire extinguishing unit, according to some embodiments of the present invention.

Reference is now made to FIG. 2, which is a schematic illustration of an exemplary valve control unit 101 connected to an exemplary fire extinguishing unit 91, according to some embodiments of the present invention. The exemplary valve control unit 101 is optionally connected to two other valve control units (not shown) by two mechanical linkages 102, such as cable, one in its left side (not shown) and the other in its right side.

Figure 3:
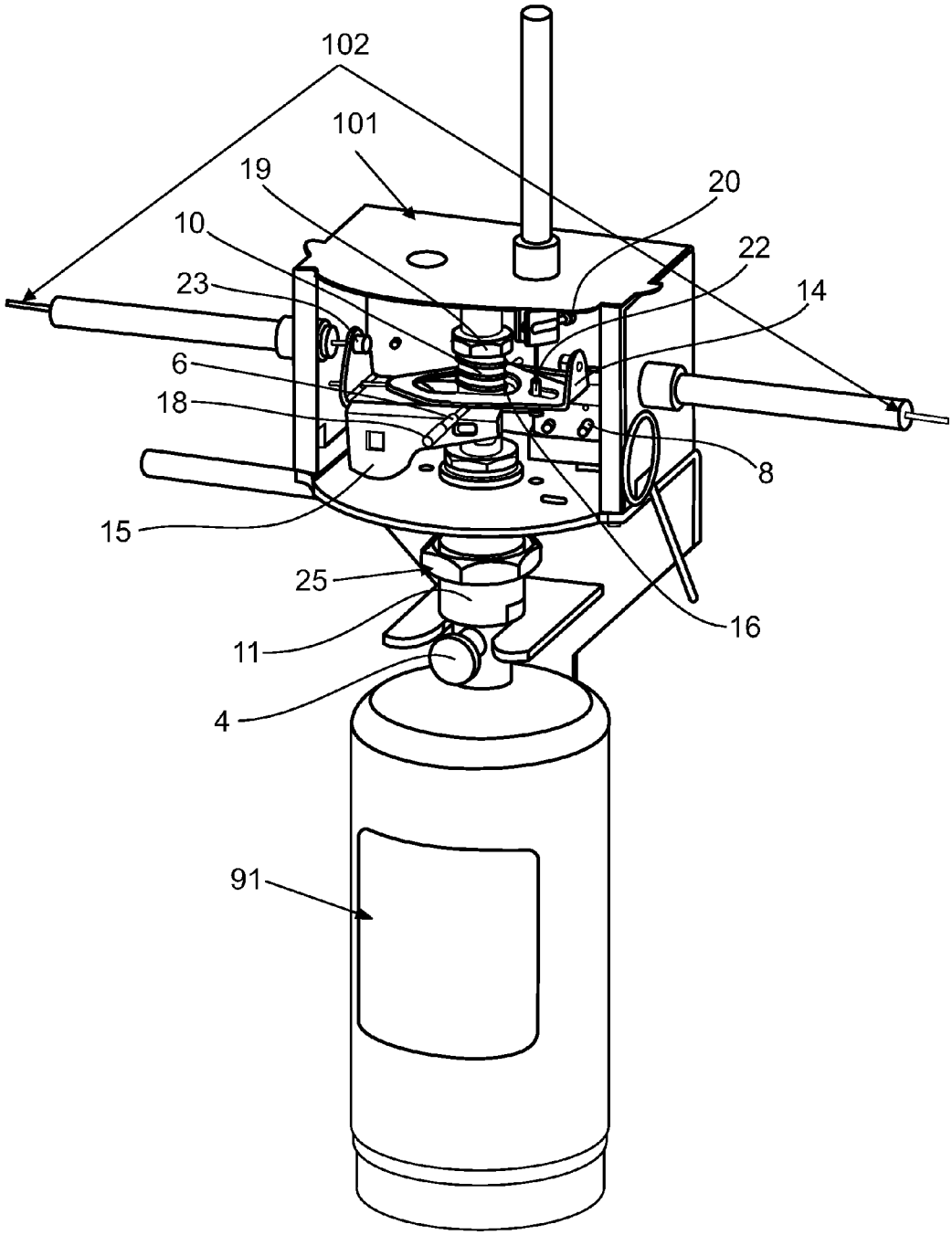
FIG. 3 is a schematic illustration of the exemplary valve control unit of FIG. 2 wherein the front side of the housing is removed, according to some embodiments of the present invention.
Figure 4:
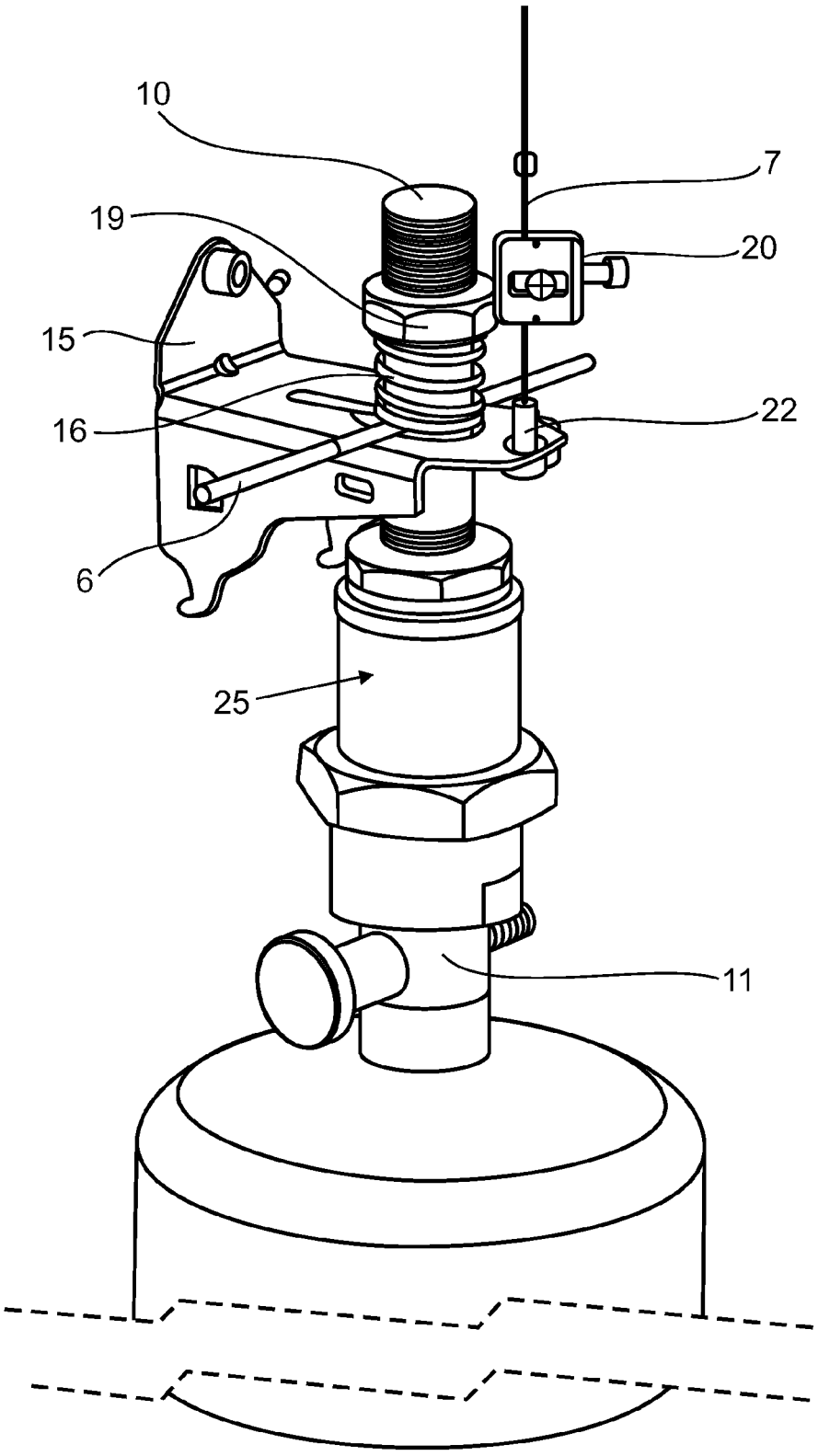
FIG. 4 is a schematic illustration of the exemplary valve control unit depicted in FIG. 3, without the housing thereof, according to some embodiments of the present invention.
Figure 5:
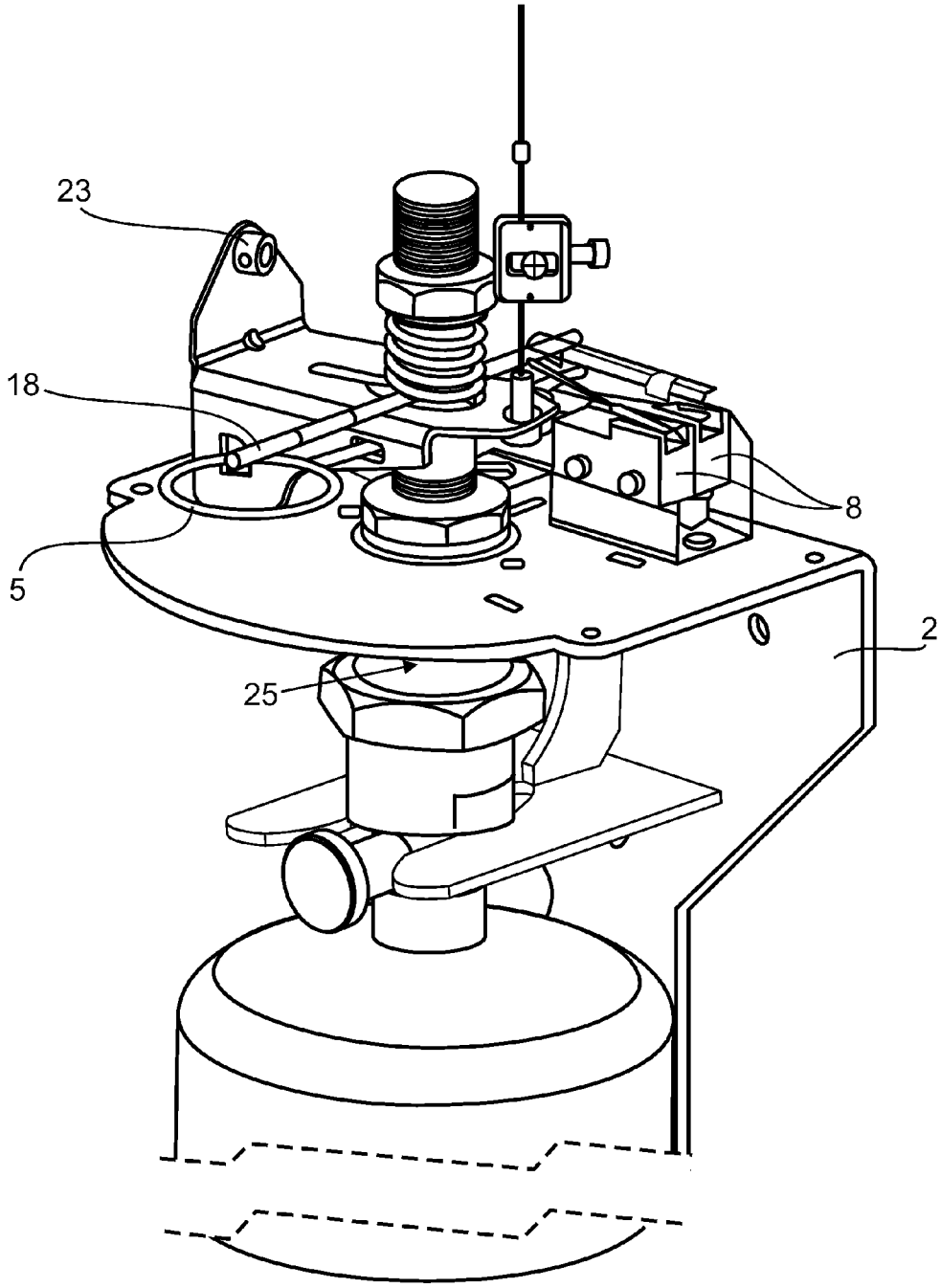
FIG. 5 is a schematic illustration of the exemplary valve control unit depicted in FIG. 3, hanged on a mount, according to some embodiments of the present invention.

Reference is also made to FIG. 3, which is a schematic illustration of the exemplary valve control unit 101 of FIG. 2 wherein the front side of the housing 1 of the exemplary valve control unit 101 is removed, according to some embodiments of the present invention. Reference is also made to FIG. 4 that is a schematic illustration of the exemplary valve control unit 101 depicted in FIG. 3, without the housing thereof, according to some embodiments of the present invention. Reference is also made to FIG. 5 which is a schematic illustration of the exemplary valve control unit 101 depicted in FIG. 3, hanged on a mount 2, according to some embodiments of the present invention.

Figure 6:
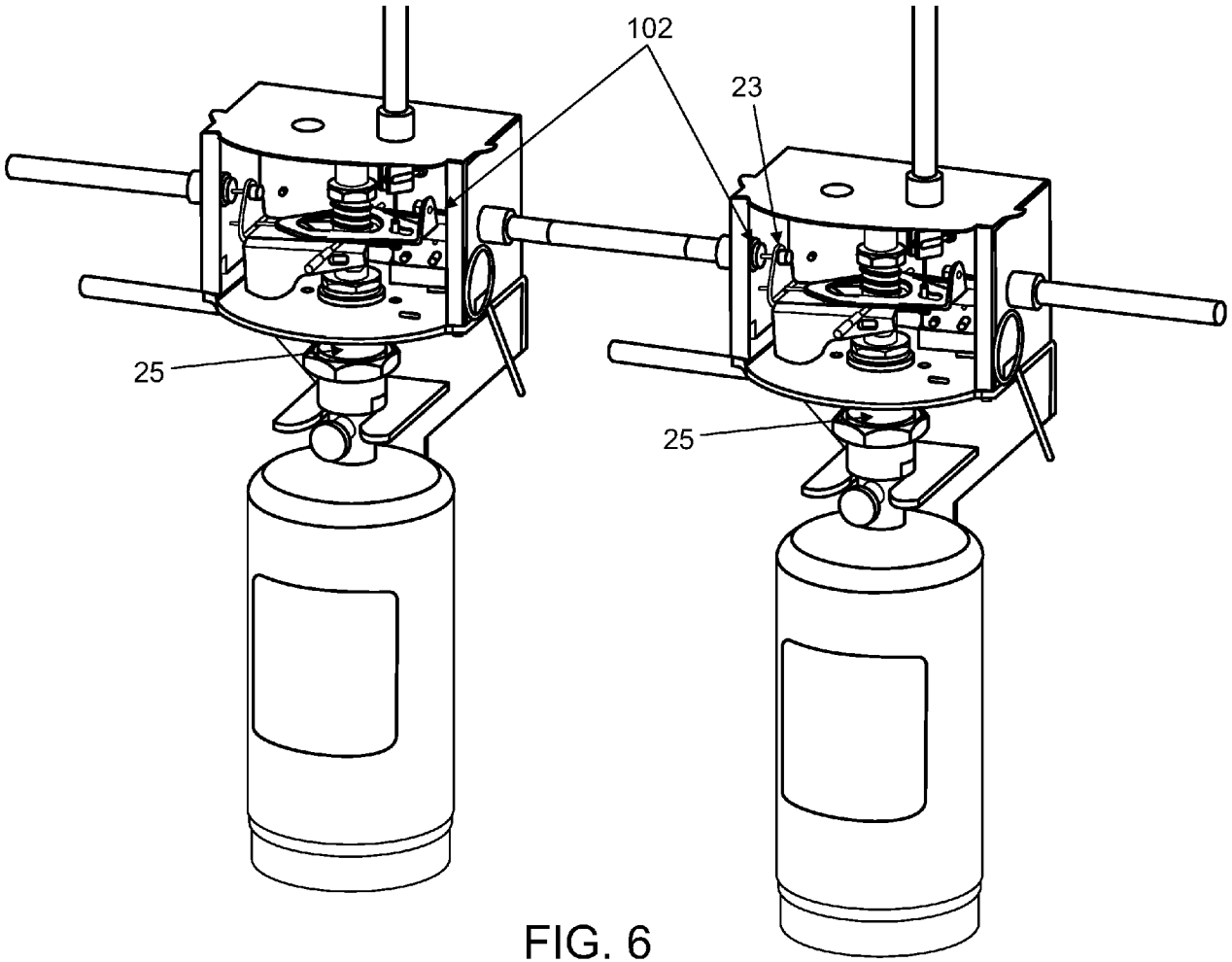
FIG. 6 is a schematic illustration of two exemplary valve control units connected to one another and set to control two different fire extinguishing units, according to some embodiments of the present invention.

As depicted in FIGS. 3-5, a mechanical lever 15 is mounted in proximity, optionally above, a plug 25 that is connected, optionally screwed, to a discharge valve 11, which may be referred to as a release valve 11, of the fire extinguishing unit 91. The mechanical lever 15 includes a mechanical linkage connector 23 that allows connecting a mechanical linkage, such as 102, thereto, for example as shown in FIG. 6 which is a schematic illustration of two exemplary valve control units 101 connected to one another and set to control two different fire extinguishing units, according to some embodiments of the present invention.

Optionally, the system 100 is modular. Any number of valve control units 101 may be connected to one another in a chain by mechanical linkages. The system 100 may include 2, 4, 6, 8, 10, and 20 or any intermediate and/or higher number of valve control units 101. The number of valve control units 101 may be reduced after installation by removing valve control units 101 and the mechanical linkages which are connected thereto. The number of valve control units 101 may be increased after installation by adding valve control units 101 by connecting them with mechanical linkages to one or more previously installed valve control units 101, for example as shown at FIG. 1. For example a new valve control unit 101 may be added by connecting it to the connector of one or more of the installed valve control units 101.

Figure 7:
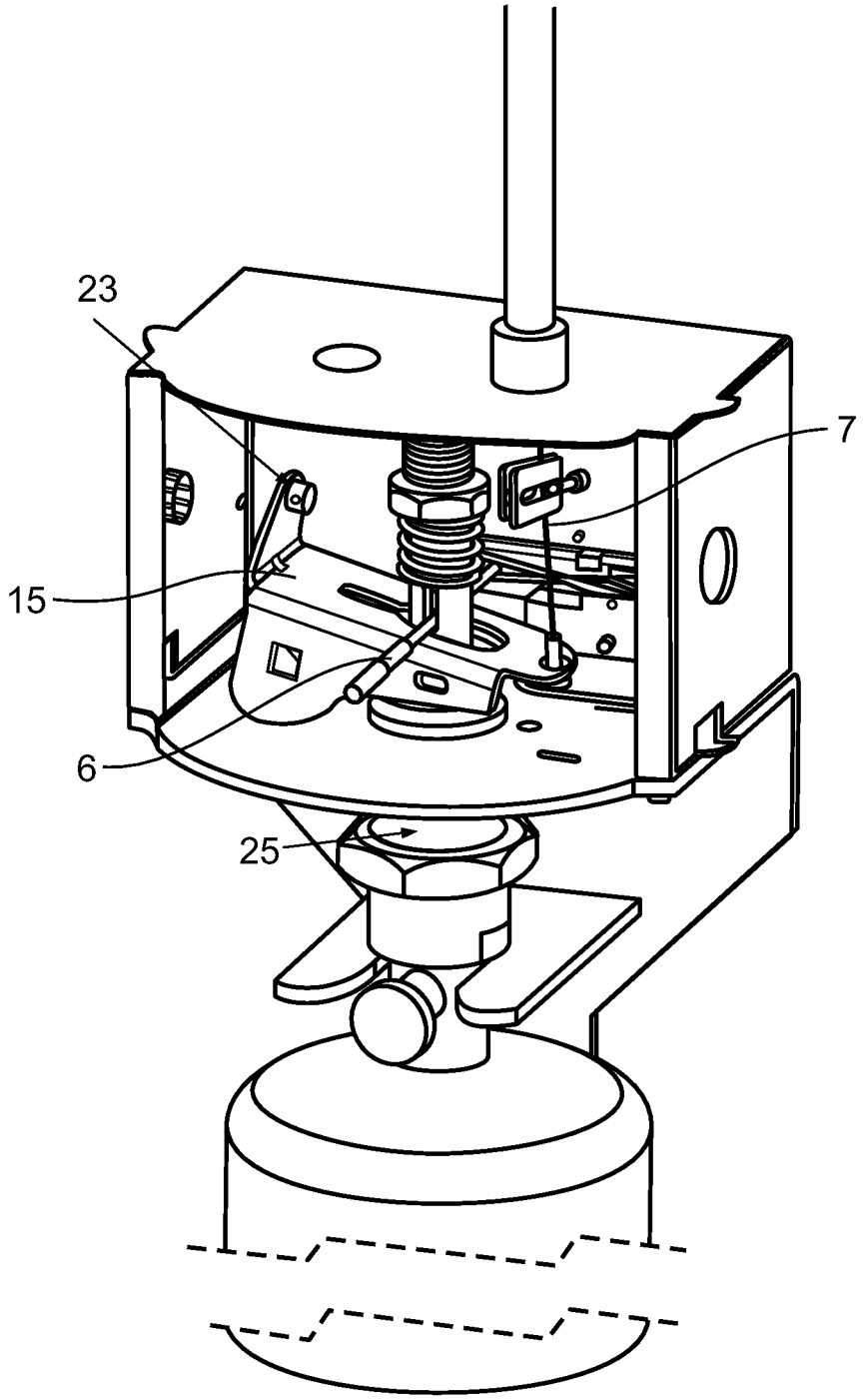
FIG. 7 is a schematic illustration of a valve control unit having its mechanical lever in a second position in which a discharge valve of a fire extinguishing unit is in an discharging mode, according to some embodiments of the present invention.

The mechanical lever 15 has first and second positions. FIGS. 3-6 depict an exemplary mechanical lever in the first position and FIG. 7, which reference is now mode to as well, depict the exemplary mechanical lever in the second position. When the mechanical lever 15 is in the second position, it activates the fire extinguishing unit 91 and drives the mechanical linkage 102 which is connected to the connector 23 simultaneously.

Figure 8:
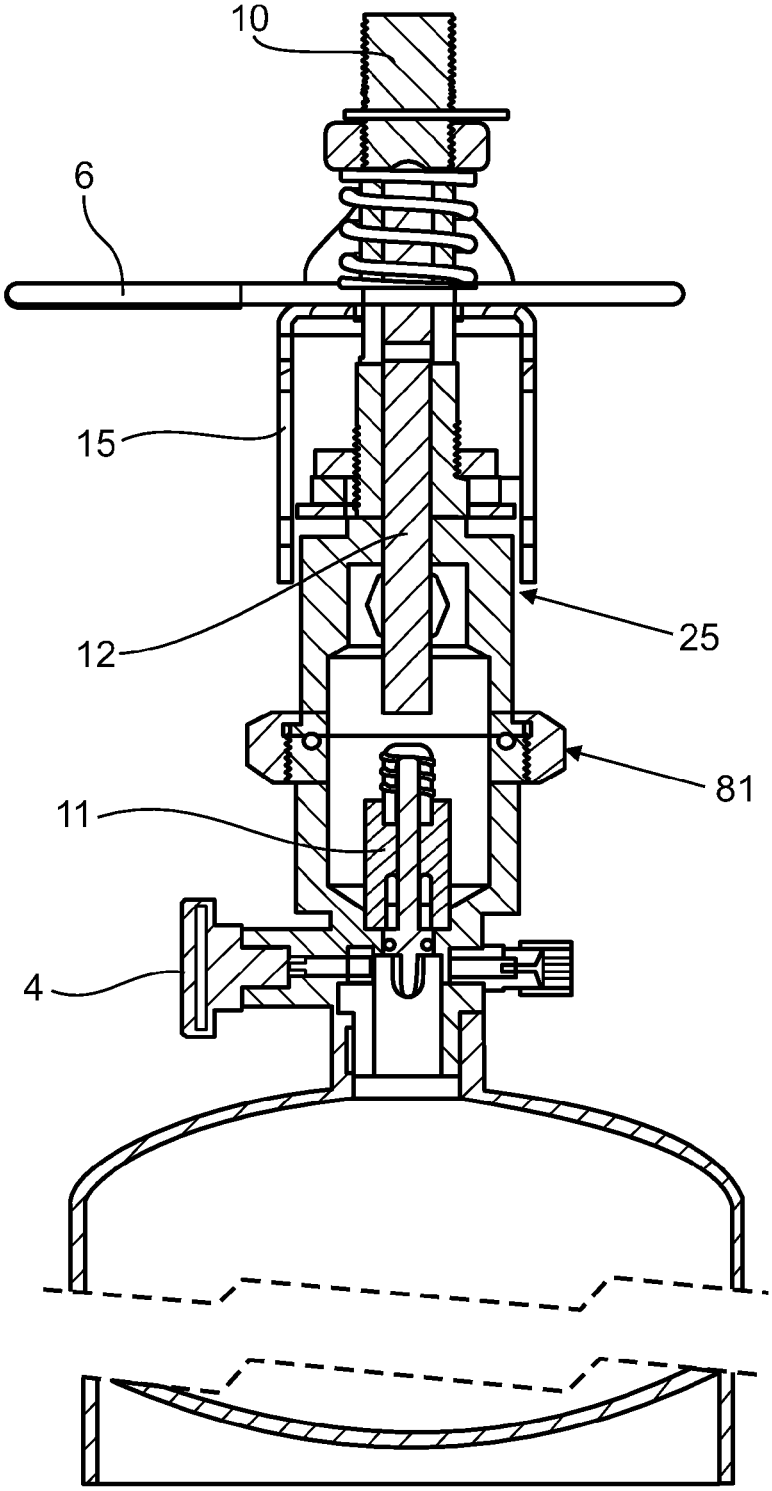
FIG. 8 is a sectional schematic illustration of a plug and proximate components of an exemplary valve control unit, according to some embodiments of the present invention.

Reference is now also made to FIG. 8, which is a sectional schematic illustration of the plug 25 and components of the exemplary valve control unit 101, according to some embodiments of the present invention. As shown at FIG. 8, the plug 25 has a recess 81 that allows screwing it to the discharge valve of a common fire extinguisher. It should be noted that various plugs may be used as adaptors of various fire extinguishing units, for example with different fire extinguishing agents.

The plug includes an operator rod 12 which is set to apply pressure on the discharge valve 11 of the fire extinguisher 91 when being pushed downwards. This pressure triggers the discharges of fire extinguishing substance by the fire extinguisher 91. It should be noted that as the fire extinguishing agents in the fire extinguisher 91 do not have to travel through long hoses prior to being discharged, the time to action of the fire extinguisher 91, the pressure required to release the fire extinguishing agents, and/or the amount of fire extinguishing agents wasted within the conducting elements of the fire extinguisher 91 during the release are reduced.

The operator rod 12 is optionally kept in place by the mechanical lever 15, which is optionally a toggle plate 15. The toggle plate 15 is held in place by an actuating element 7, such as an operation cable 7 which is connected to the mechanical lever 15, for example by a cable end piece 22, and extended along an axis which is parallel to the longitudinal axis of the operator rod 12. Optionally, the operation cable 7 is connected to a cable adjuster 20 to allow the adjustment thereof.

Optionally, a pusher pin 6 is threaded via an opening in the operator rod 12, above the toggle plate 15. The pusher pin 6 is held between the toggle plate 15 and an operator spring 16 which is placed above the toggle plate 15. The operator spring 16 is cocked by a nut 19 which is screwed on a cylinder 10 thereabove. The nut is optionally locked above the operator spring 16 with a split-pin when it reaches a certain tension. The pressure applied by the operator spring 16 maintains the pusher pin 6 in place. Toggle plate 15 is held in the first position in spit of the pressure applied by the pusher pin 6 pressed by the operator spring 16. The actuating element 7 is connected to a detection unit having one or more fire detectors such as a mechanical heat activation devices. For example, the operation cable 7 is connected to a fuse element which melts and breaks under excess temperature. The breaking of the fuse element releases the operation cable 7, allowing the toggle plate 15 to move to the second position where the operator rod 12 sets the discharge valve 11 in a discharging mode. Optionally, the detection unit comprises one or more micro switches 8 which are set to trigger additional fire extinguishing operations such as shutting down the electricity in the space, activating a fire alarm, calling an emergency line and/or any other preset number and the like.

When the operation cable 7 is released, the pressure applied by the pusher pin 6 pushed the toggle plate 15 to the second position, set the discharge valve to discharge the fire extinguishing agent. Optionally, a position flag 18 is attached to the pusher pin 6, indicating that the mechanical lever 15 is in the first position, in a standby mode, or in the second position after activating the fire extinguishing unit 91.

As the triggering of the valve control units 101 is performed mechanically no electricity may be needed. The mechanical levers 15 are actuated by the operation springs 16. In such a manner, the valve control units 101 may be placed in locations without electricity infrastructure and/or sockets and/or without a battery support.

Optionally, a safety pin 5 locks the mechanical lever 15 in the first position to prevent accidental activation during installation. Optionally, in order to remind the installer of the valve control unit 101 to remove the safety pin 5, the front of the housing 1 cannot be placed to without removing the safety pin 5. Optionally, after the installment of the valve control unit 101, the safety pin 5 may be placed to lock the housing 1. Optionally, the front side of the housing 1 as an opening to allow an operator to see a pressure gauge 4 of the fire extinguishing unit 91 which is connected thereto.

According to some embodiments of the present invention, the valve control unit 101 includes a manual operation mechanism that allows manually operating the fire extinguishing unit 91 which is connected thereto and simultaneously triggers the operation of other fire extinguishing units which are connected to other valve control units 101 of the system 100. Optionally, an external trigger operation cable in a protection tube 9 is connected to a manual operation handle. When the user manipulates the handle, the external trigger operation cable 9 respectively drives an external trigger operation bracket 14 that releases the cable end piece 22 of the operation cable 7 from the trigger plate 15, thereby manually activates the fire extinguishing unit 101 and pulling, rotating, pushing or otherwise driving the mechanical linkage 102.

Figure 9:
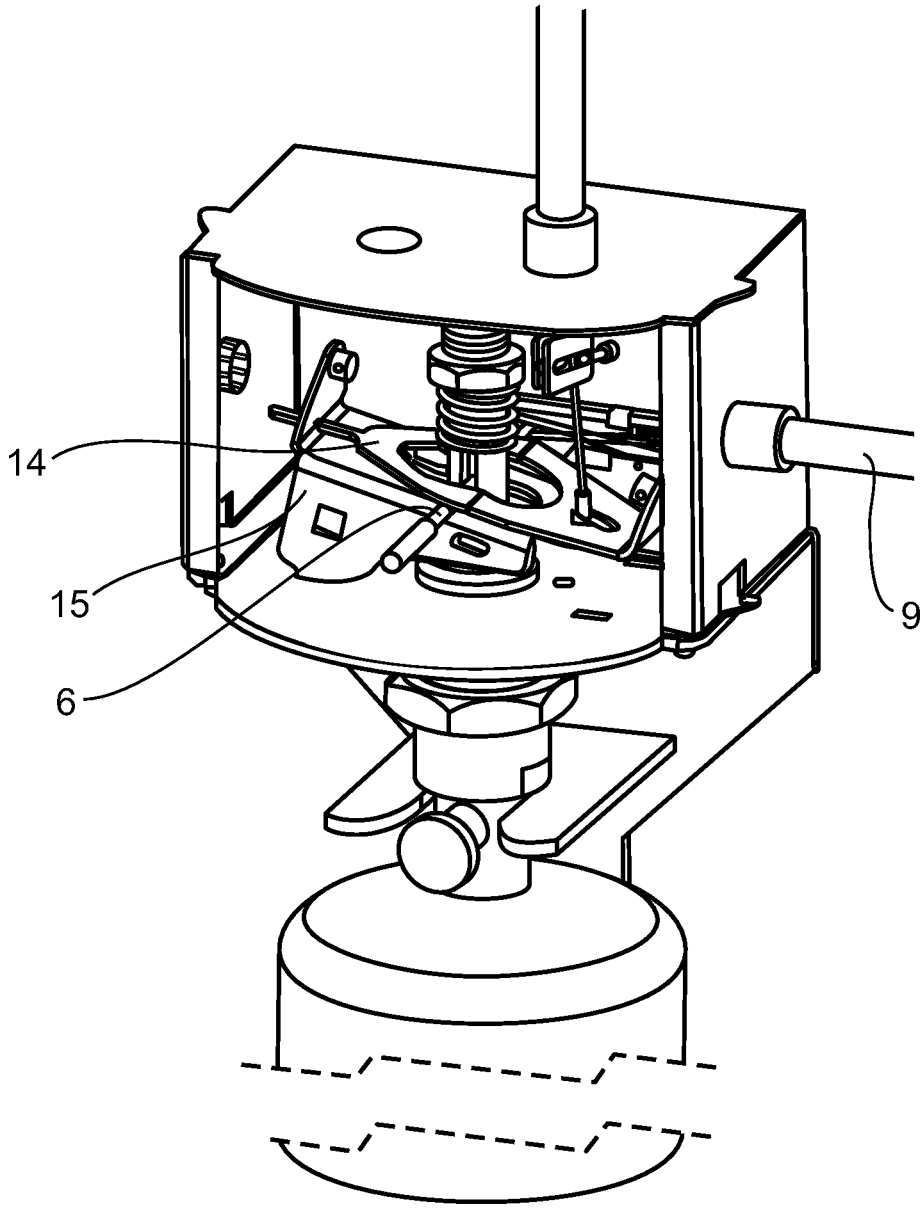
FIG. 9 is a schematic illustration of a valve control unit, such as shown in FIG. 2, which is connected via a mechanical linkage to another valve control unit, according to some embodiments of the present invention.

Reference is now made to a description of triggering a valve control unit, such as 101, which is connected to, via a mechanical linkage, to another valve control unit, for example as described above and depicted in FIG. 9. The external trigger operation cable 9 is optionally connected, via a mechanical linkage, such as a cable, to the connector 23 of another valve control unit. By triggering the other valve control unit, the Trigger Plate 15 is tilted around its support point, thus pulling, rotating, pushing or otherwise driving the mechanical linkage 102. In the depicted example, the cable pulls the external trigger operation bracket 14, releases the cable end piece 22 from the trigger plate 15 and activates the fire extinguishing unit 101.

Reference is now made, once again, to FIG. 5. After the valve control units 101 are installed, for example by connecting the mount 2 to a surface, such as a wall and after starching the mechanical linkages 102 between the valve control units 101, fire extinguishing units 91 may be replaced without affecting the mode of the valve control units 101. As the detaching of the fire extinguishing unit 91 from the valve control unit 101 is performed by screwing it out from the plug 25 and as the placing of a new fire extinguishing unit as a replacement is done by screwing it into the recess of the plug 25, the position of the mechanical tray does not change. In such a manner, the fire extinguishing units 91 may be replaced without triggering the activation of other fire extinguishing units 91.

Figure 10:
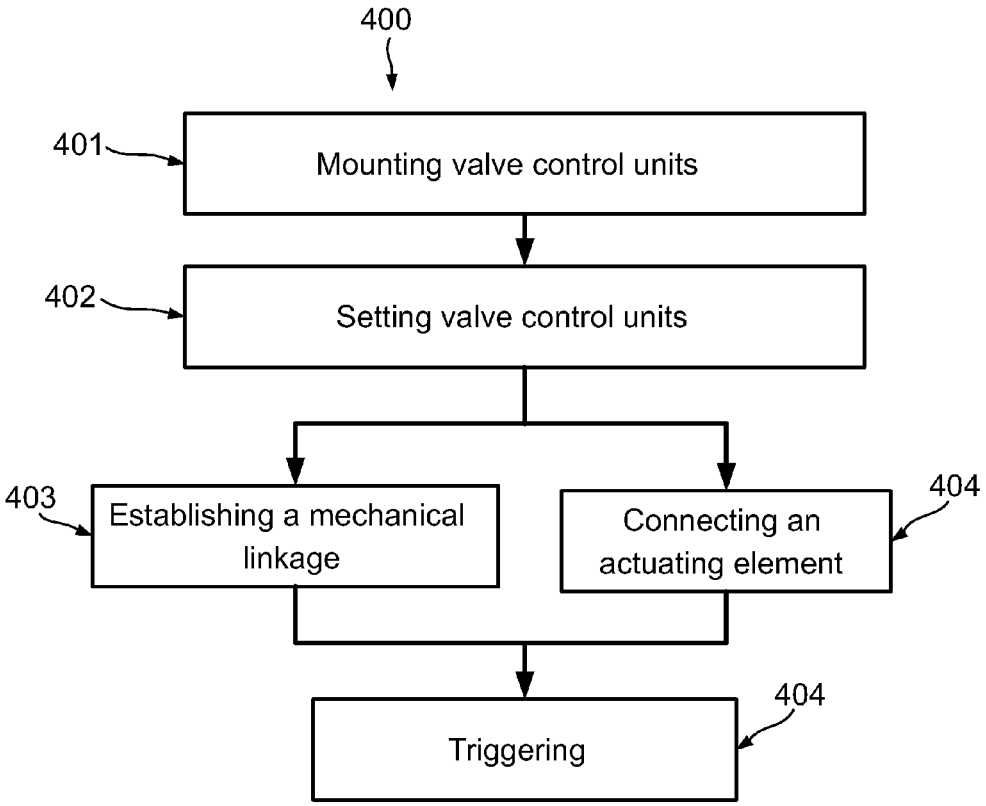
FIG. 10 is a flowchart of method of setting a fire suppression system having a plurality of fire extinguishing units to suppress fire in a space, according to some embodiments of the present invention.

Reference is now made to FIG. 10, which is a flowchart of method 400 of setting a fire suppression system having a plurality of fire extinguishing units 91. First, as shown at 401, the valve controls units 101 are mounted in a plurality of surfaces in a space, for example using mounts, each for example as shown at 2 of FIG. 5. Than, as shown at 402, each valve control 101 is set to activate one of the fire extinguishing units 91 in response to the triggering thereof. For example, the fire extinguishing unit 91 is connected to the plug 25, similarly to the described above. Than, as shown at 403, a mechanical linkage between each two of the valve control units 101 is established, for example as depicted in FIGS. 1 and 6 and described above. Now, as shown at 404, one of the valve control units 101 is connected to be triggered by an actuating element, as shown by numeral 7 in FIG. 4. This allows, as shown at 405, using the valve control unit 101 to activate one of the plurality of fire extinguishing units 101 and to trigger all the other valve control units 101, using the mechanical linkage, simultaneously or substantially simultaneously for example as described above. As used herein, substantially simultaneously means performed within a period of less than 5 seconds, for example less than 1 second. Optionally, the actuating element is connected to a detection unit, as defined above, which is set to detect fire in the space.

It is expected that during the life of a patent maturing from this application many relevant systems and methods will be developed and the scope of the term a handheld fire extinguisher, a container, and a fire extinguishing agent is intended to include all such new technologies a priori.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A system of operating a plurality of fire extinguishing units, comprising:

a plurality of valve control units each set to activate one of the plurality of fire extinguishing units when triggered and to trigger the activation of another of the plurality of fire extinguishing units by another of said plurality of valve control units substantially simultaneously;

an actuating element which triggers one of said plurality of valve control units; and at least one mechanical linkage each connecting between two of said plurality of valve control units, each said valve control unit triggering said another valve control unit by driving one of said at least one mechanical linkage.

2. The system of claim 1, wherein said actuating element triggers the activation of all said plurality of fire extinguishing units by triggering said one of said plurality of valve control units.

3. The system of claim 2, wherein the activation of all said plurality of fire extinguishing units is performed by a mechanical chain reaction.

4. The system of claim 1, wherein plurality of valve control units are set to be connected in a chain by a plurality of mechanical linkages.

5. The system of claim 1, wherein each said valve control unit is set to activate one of said fire extinguishing units by manipulating a discharge valve thereof.

6. The system of claim 1, wherein each said valve control unit mechanically activates one of the plurality of fire extinguishing units.

7. The system of claim 1, wherein each said fire extinguishing unit is detachably connected to a respective said valve control unit so as to allow detaching any of said the plurality of fire extinguishing units without triggering any other of the plurality of fire extinguishing units.

8. The system of claim 1, wherein each said valve control unit mechanically triggers said another valve control unit.

9. The system of claim 1, further comprising a fire detection unit for activating said actuating element in response to the detection of a fire indication.

10. The system of claim 9, wherein said fire detection unit comprises a mechanical heat activation device.

11. The system of claim 1, wherein each said fire extinguishing unit is detachably connected to a respective said valve control unit so as to allow the detaching thereof without disassembling said valve control unit.

12. A system of operating a plurality of fire extinguishing units, comprising:

a plurality of valve control units each performs an activation of one of the plurality of fire extinguishing units when being triggered; and at least one mechanical linkage each connecting between two of said plurality of valve control units;

wherein each of a group of said plurality of valve control units is set to trigger another of said plurality of valve control units by driving one of said at least one mechanical linkage simultaneously with said activation.

13. The system of claim 12, wherein said at least one mechanical linkage is a flexible cable.

14. The system of claim 12, further comprising a single detection unit which detects at least one fire indication and triggers one of said plurality of valve control units in response to said at least one fire indication.

15. A method of operating a plurality of fire extinguishing units, comprising:

activating a first of the plurality of fire extinguishing units using a mechanical lever; and driving a mechanical linkage connected to a valve control unit to activate a second of the plurality of fire extinguishing units;

wherein said activating and driving are performed simultaneously by maneuvering said mechanical lever.

16. The method of claim 15, wherein said driving comprises pulling said mechanical linkage.

17. The method of claim 15, wherein said driving triggers a maneuvering of an additional mechanical lever set to activate said second fire extinguishing and to drive an additional mechanical linkage connected to an additional valve control unit to activate a third of the plurality of fire extinguishing units.

18. A method of setting a fire suppression system having a plurality of fire extinguishing units, comprising:

mounting a plurality of valve control units in a plurality of surfaces in a space;

setting each said valve control to activate one of the plurality of fire extinguishing units in response to the triggering thereof;

establishing a mechanical linkage between each two of said valve control units; and connecting a first of said valve control units to an actuating element set to trigger one of said valve control unit;

wherein a triggering of said first valve control unit activates one of said plurality of fire extinguishing units and drives mechanical linkage to trigger all other of said valve control units.

* * * * *